US008695570B2

(12) United States Patent
Lindner et al.

(10) Patent No.: US 8,695,570 B2
(45) Date of Patent: Apr. 15, 2014

(54) FUEL DISTRIBUTOR SYSTEM FOR A MOTOR VEHICLE, AND METHOD OF MANUFACTURING A FUEL DISTRIBUTOR SYSTEM

(75) Inventors: Marko Lindner, Ingolstadt (DE); Karsten Krippner, Ingolstadt (DE)

(73) Assignee: Audi AG, Ingolstadt (DE)

( * ) Notice: Subject to any disclaimer, the term of this patent is extended or adjusted under 35 U.S.C. 154(b) by 364 days.

(21) Appl. No.: 13/086,882

(22) Filed: Apr. 14, 2011

(65) Prior Publication Data

US 2012/0090576 A1 Apr. 19, 2012

(30) Foreign Application Priority Data

Apr. 14, 2010 (DE) ..... 10 2010 014 947

(51) Int. Cl.
*F02M 69/50* (2006.01)
*F02M 69/46* (2006.01)

(52) U.S. Cl.
USPC ..... 123/456; 123/468

(58) Field of Classification Search
USPC ..... 123/468, 469, 470, 456, 447; 239/600
See application file for complete search history.

(56) References Cited

U.S. PATENT DOCUMENTS

| | | | | |
|---|---|---|---|---|
| 4,294,215 | A | 10/1981 | Hans et al. | |
| 5,359,976 | A * | 11/1994 | Nakashima et al. | 123/516 |
| 5,471,692 | A | 12/1995 | Wasinger et al. | |
| 6,374,805 | B1 | 4/2002 | Seymour, II et al. | |
| 6,374,806 | B1 | 4/2002 | Keeley et al. | |
| 6,418,911 | B1 | 7/2002 | Augustin | |
| 6,935,314 | B2 | 8/2005 | Zdroik et al. | |
| 7,118,140 | B2 * | 10/2006 | Kilgore | 285/374 |
| 2010/0012093 | A1 * | 1/2010 | Pepperine et al. | 123/470 |

FOREIGN PATENT DOCUMENTS

| | | |
|---|---|---|
| EP | 1 224 390 | 7/2002 |
| JP | 2003-254167 | 9/2003 |
| JP | 2003-307164 | 10/2003 |
| JP | 2005-273475 | 10/2005 |
| WO | WO 01/53697 | 7/2001 |
| WO | WO 2005/090775 | 9/2005 |

* cited by examiner

*Primary Examiner* — Mahmoud Gimie
(74) *Attorney, Agent, or Firm* — Henry M Feiereisen LLC

(57) ABSTRACT

A fuel distributor system for a motor vehicle includes a fuel pipe having an interior space, and at least one receiving tube for receiving an injector. The receiving tube is arranged on the fuel pipe and configured to project into the interior space of the fuel pipe. The receiving tube has an end face formed with an opening for introduction of fuel, and includes a first portion which is arranged in the interior space of the fuel pipe, and a second portion which is arranged outside the fuel pipe. The first portion has an axial dimension which is greater than an axial dimension of the second portion of the receiving tube.

10 Claims, 1 Drawing Sheet

FUEL DISTRIBUTOR SYSTEM FOR A MOTOR VEHICLE, AND METHOD OF MANUFACTURING A FUEL DISTRIBUTOR SYSTEM

CROSS-REFERENCES TO RELATED APPLICATIONS

This application claims the priority of German Patent Application, Serial No. 10 2010 014 947.0, filed Apr. 14, 2010, pursuant to 35 U.S.C. 119(a)-(d), the content of which is incorporated herein by reference in its entirety as if fully set forth herein.

BACKGROUND OF THE INVENTION

The present invention relates to a fuel distributor system for a motor vehicle, and to a method of manufacturing a fuel distributor system.

It would be desirable and advantageous to provide an improved fuel distributor system which obviates prior art shortcomings and is simple in structure and yet reliable in operation while requiring little installation space. It would also be desirable and advantageous to provide an improved method of manufacturing a fuel distributor system.

SUMMARY OF THE INVENTION

According to one aspect of the present invention, a fuel distributor system for a motor vehicle includes a fuel pipe having an interior space, and at least one receiving tube for receiving an injector, the receiving tube being arranged on the fuel pipe and configured to project into the interior space of the fuel pipe, the receiving tube having an end face formed with an opening for introduction of fuel from the fuel pipe, the receiving tube having a first portion which is arranged in the interior space of the fuel pipe, and a second portion which is arranged outside the fuel pipe, with the first portion having an axial dimension which is greater than an axial dimension of the second portion of the receiving tube.

As a major part of the receiving tube is received in the interior space of the fuel pipe, a fuel distributor system according to the present invention requires little installation space in a direction of the axial dimension of the receiving tube. The presence of the terminal opening allows introduction of fuel in axial direction into the receiving tube, without the need to refinish the receiving tube, for example by providing bores. Thus, a fuel distributor system according to the present invention is simple in structure.

According to another advantageous feature of the present invention, the opening is defined by a diameter which can be the same as a diameter of the receiving tube at a location of insertion of the receiving tube in an opening of the fuel pipe. Instead of requiring a formed part that is complicated and expensive to manufacture, the present invention allows the provision of a simple tubular piece as a semifinished product for use as receiving tube. There is no need to provide the receiving tube with a bottom part. The presence of an axial opening of comparably large diameter also permits introduction of fuel into the receiving tube at little flow resistance.

According to another advantageous feature of the present invention, the receiving tube has an injector-distal end which can be in contact with an inner wall of the fuel pipe. This provides the receiving tube with high stability against tilting. In addition, a fuel distributor system can be manufactured with high precision. The depth of insertion of the receiving tube into the fuel pipe is predefined by the inner diameter of the fuel pipe. As a result, the receiving tube and the fuel pipe can both be manufactured with high precision with little effort to be expended.

Another benefit involves the possibility to place several receiving tubes on the fuel pipe in such a way that the receiving tubes project out from the fuel pipe at a same length and at a same orientation in relation to the fuel pipe. This simplifies manufacture because a contact of the receiving tube with the inner wall of the fuel pipe can be implemented in an automated manufacturing process in an especially simple manner.

According to another advantageous feature of the present invention, the receiving tube defines a center axis which can intersect a center axis of the fuel pipe. When placing the receiving tube in midsection into the fuel pipe, the receiving tube can be pushed into the fuel pipe far enough as to contact the inner wall of the fuel pipe at two spots. Advantageously, the center plane of the receiving tube intersects the center plane of the fuel pipe at a right angle. This provides high stability of the receiving tube in a direction transversely to its center axis and a defined orientation of the receiving tube.

According to another advantageous feature of the present invention, the receiving tube can have a conical configuration in a direction towards the injector-distal end of the receiving tube. In this way, there is especially good contact of the receiving tube with the fuel pipe, in particular when the fuel pipe is of round configuration. Advantageously, the conical shape of the receiving tube conforms to a curvature of the inner wall of the fuel pipe so that the receiving tube rests flatly across its entire wall thickness upon the inner wall of the fuel pipe.

According to another advantageous feature of the present invention, the receiving tube can be press-fitted in an opening of the fuel pipe. This results in an especially stable union of the receiving tube with the fuel pipe.

According to another advantageous feature of the present invention, the receiving tube can be connected to the fuel pipe by soldering or welding. In this way, a tight seat of the receiving tube in the fuel pipe can be realized.

According to another advantageous feature of the present invention, the receiving tube has an injector-proximal end which can be formed with a circumferential lip. Such a lip can be used for support of a spring element which exerts a spring force upon the injector and thus provides a tolerance in the event the actual position of the injector deviates from a desired position. The presence of a lip is easy to make by simply suitably shaping an end zone of a tubular piece which can serve as semifinished product for the receiving tube.

According to another aspect of the present invention, a method of manufacturing a fuel distributor system for a motor vehicle includes the steps of inserting a receiving tube for an injector into an interior space of a fuel pipe such that a first portion of the receiving tube projects into the interior space of the fuel pipe to an axial extent which is greater than an axial dimension of a second portion of the receiving tube outside the fuel pipe, and securing the receiving tube on the fuel pipe such that fuel is able to enter the receiving tube from the fuel pipe via an axial opening of the receiving tube.

In accordance with the present invention, the receiving tube is thus inserted further into the interior space of the fuel pipe to an axial extent that exceeds the axial dimension of the receiving tube extending out of the fuel pipe. As a result, a fuel distributor system according to the present invention can be manufactured in a simple manner and requires little installation space.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
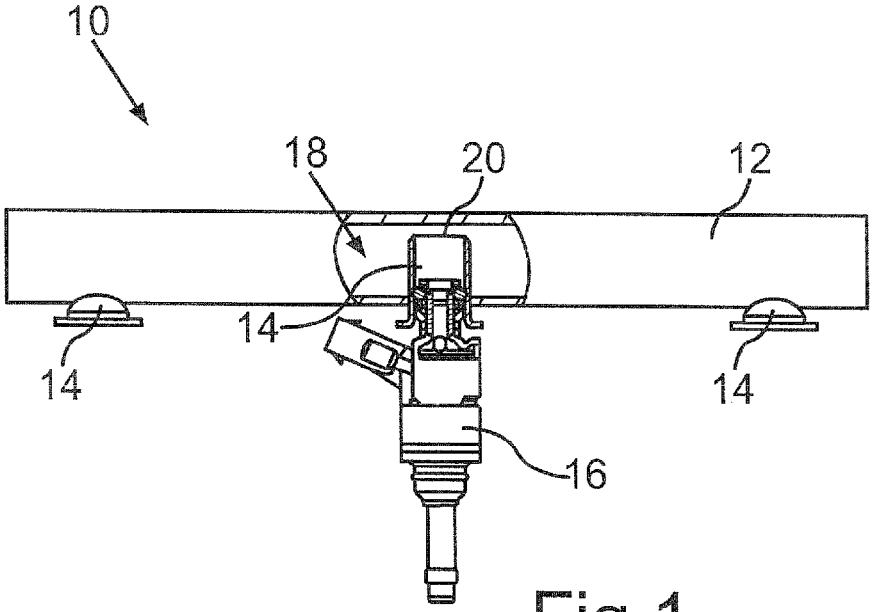
FIG. 1 is a partly sectional side view of a fuel distributor system according to the present invention.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a partly sectional side view of a fuel distributor system according to the present invention, generally designated by reference numeral 10, for use in a motor vehicle. The fuel distributor system 10 includes a fuel pipe 12, which has a generally round configuration, and a plurality of receiving tubes 14, of which three are shown by way of example. Each of the three receiving tubes 14 receives an injector 16 by which fuel under high pressure is injected from an interior space 18 of the fuel pipe 12 into a (not shown) combustion chamber of an internal combustion engine.

As can be seen from FIG. 1, only a minor portion of each receiving tube 14 extends out from the fuel pipe 12 while a major portion of the each receiving tube 14 is arranged in the interior space 18 of the fuel pipe 12. As a result, the installation height of the fuel distributor system 10 is slight. The receiving tube 14 is made from a simple tubular piece which is pushed into the fuel pipe 12 to such an extent that an upper injector-distal end 20 of the receiving tube 14 contacts an inner wall 22 of the fuel pipe 12.

Figure 2:
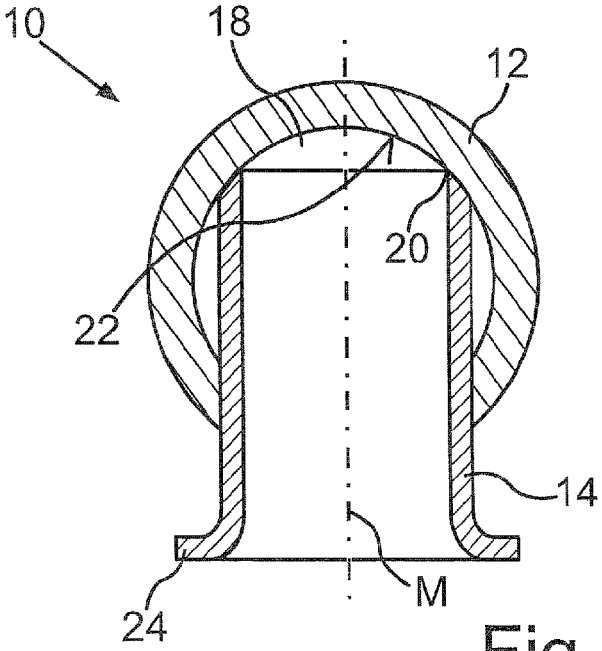
FIG. 2 is a sectional view of the fuel distributor system of FIG. 1 in an area of a receiving tube.

Suitably, the receiving tube 14 is of conical shape or beveled in a direction of the upper end 20 in order to realize an especially good contact upon the round fuel pipe 12, as can be seen from FIG. 2.

The upper end 20 of the receiving tube 14 defines at the same time a terminal opening via which fuel from the interior space 18 of the fuel pipe 12 is able to enter the receiving tube 14.

The receiving tube 14 defines a center axis M which extends in midsection through the fuel pipe 12. The receiving tube 14 is soldered or welded to the fuel pipe 12 in an area of an opening via which the receiving tube 14 is inserted into the fuel pipe 12.

A circumferential lip 24 is formed on a bottom side of the receiving tube 14 for support of a (not shown) spring element which applies a spring force upon the injector 16 placed in the receiving tube 14.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A fuel distributor system for a motor vehicle, comprising:

a fuel pipe having an interior space; and at least one receiving tube for receiving an injector, said receiving tube being arranged on the fuel pipe and configured to project into the interior space of the fuel pipe, said receiving tube having an end face formed with an opening for introduction of fuel from the fuel pipe, said receiving tube having a first portion which is arranged in the interior space of the fuel pipe, and a second portion which is arranged outside the fuel pipe, said first portion having an axial dimension which is greater than an axial dimension of the second portion of the receiving tube, wherein the receiving tube has an injector-distal end in contact with an inner wall of the fuel pipe.

2. The fuel distributor system of claim 1, wherein the opening is defined by a diameter which corresponds to a diameter of the receiving tube at a location of insertion of the receiving tube in an opening of the fuel pipe.

3. The fuel distributor system of claim 1, wherein the receiving tube has a conical configuration in a direction towards the injector-distal end of the receiving tube.

4. The fuel distributor system of claim 3, wherein the receiving tube is constructed to conform the conical configuration to a curvature of the inner wall of the fuel pipe.

5. The fuel distributor system of claim 1, wherein the receiving tube defines a center axis which intersects a center axis of the fuel pipe.

6. The fuel distributor system of claim 5, wherein the center plane of the receiving tube intersects the center plane of the fuel pipe at a right angle.

7. The fuel distributor system of claim 1, wherein the receiving tube is press-fitted in an opening of the fuel pipe.

8. The fuel distributor system of claim 1, wherein the receiving tube is connected to the fuel pipe by soldering or welding.

9. The fuel distributor system of claim 1, wherein the receiving tube has an injector-proximal end formed with a circumferential lip.

10. A method of manufacturing a fuel distributor system for a motor vehicle, comprising the steps of:

inserting a receiving tube for an injector into an interior space of a fuel pipe such that a first portion of the receiving tube projects into the interior space of the fuel pipe to an axial extent which is greater than an axial dimension of a second portion of the receiving tube outside the fuel pipe, and so that an injector-distal end of the receiving tube is in contact with an inner wall of the fuel pipe; and securing the receiving tube on the fuel pipe such that fuel is able to enter the receiving tube from the fuel pipe via an axial opening of the receiving tube.

* * * * *